US007225718B1

(12) United States Patent
Grove et al.

(10) Patent No.: US 7,225,718 B1
(45) Date of Patent: Jun. 5, 2007

(54) MILITARY VEHICLE WINDOW COVER

(75) Inventors: Lee A. Grove, Mishawaka, IN (US); Donald F. Rhoad, Bamberg, SC (US)

(73) Assignee: Defense Consulting Services, Inc., Bamberg, SC (US)

( * ) Notice: Subject to any disclaimer, the term of this patent is extended or adjusted under 35 U.S.C. 154(b) by 0 days.

(21) Appl. No.: 11/333,783

(22) Filed: Jan. 17, 2006

Related U.S. Application Data

(60) Provisional application No. 60/644,116, filed on Jan. 14, 2005.

(51) Int. Cl.
*F41H 5/14* (2006.01)

(52) U.S. Cl. ..... 89/36.09; 89/36.07; 89/36.08; 89/36.14

(58) Field of Classification Search ..... 89/36.09, 89/36.07, 36.08, 36.14
See application file for complete search history.

(56) References Cited

U.S. PATENT DOCUMENTS 4,326,445 A 4/1982 Bemiss
4,934,246 A 6/1990 Benson et al.
5,128,803 A 7/1992 Sprafke
5,315,915 A 5/1994 Sprafke
5,452,641 A 9/1995 Kariya
5,749,140 A 5/1998 Polito et al.
6,178,451 B1 1/2001 Huitema et al.
2004/0016058 A1* 1/2004 Gardiner et al. ..... 7/119

* cited by examiner

*Primary Examiner*—Michael J. Carone
*Assistant Examiner*—Gabriel J. Klein
(74) *Attorney, Agent, or Firm*—Botkin & Hall, LLP

(57) ABSTRACT

A window cover for a military vehicle which includes both upper and lower armored plates angled away from an underlying vehicle window, an upper reflector overlying the underside of the upper armored plate, and a lower reflector, penetrable by projectiles, positioned in front of the lower armored plate. The window cover allows an occupant of the vehicle to view outside the vehicle window, as light is reflected off the lower reflector onto the upper reflector and then toward the occupant.

5 Claims, 6 Drawing Sheets

MILITARY VEHICLE WINDOW COVER

CROSS REFERENCE TO RELATED APPLICATIONS

This application is a continuation of Provisional Application No. 60/644,116 filed Jan. 14, 2005, and claims the benefit thereof.

BACKGROUND OF THE INVENTION

1. Field of the Invention

The invention disclosed herein relates to a military vehicle window cover for protecting an underlying windshield, and more specifically to a military vehicle window cover using a combination of mirrors and plates of bulletproof armor to deflect or stop incoming fire while allowing unobstructed visibility through the vehicle's window.

2. Description of the Background of the Invention

Bullet-resistant glass-pane windows, while offering some improvement to battle zone survivability, have by nature many unwanted traits that have limited their effectiveness at maintaining functionality of a vehicle under fire and safety of the occupants within that vehicle. A bullet-resistant window is a multi-layered assembly of plastic and glass, held in place with a single welded frame and adds hundreds of pounds of excess weight to a vehicle, causing a high cost of replacement when damaged and vehicle performance to suffer due to the added weight. Additionally, with the layered construction of a bullet-resistant window, night vision gear is rendered inoperable and loss of visibility through the window is a certainty due to the shattering of the bullet-resistant glass when projectiles, such as bullets and shrapnel, hit its surface.

Improvements have been made in this art, notably U.S. Pat. No. 5,452,641, which proposes a transparent armor piercing protection system with angled, mirrored louvers in an aperture with a sheet of transparent armor provided adjacent to the aperture. When a projectile strikes the louvers, the louvers will either stop the projectile or cause it to fragment, with the remaining fragments stopped by the adjacent sheet of transparent armor. The solution of louvers themselves does not essentially solve the problems of weight or visibility loss, as each louver is constructed to stop or fragment projectiles, adding to the overall weight and marring the mirrored surface of each louver. Additionally, the adjacent sheet of transparent armor fractures when stopping or deflecting projectiles, and loss of vision still occurs.

SUMMARY OF THE INVENTION

Accordingly, it is an object of the present invention to provide a window cover apparatus that provides an unobstructed view through a window while offering armored protection to the window through a system of mirrored surfaces and armored plates.

It is a further object of the present invention to provide a window cover apparatus that can withstand several of projectile hits without loss of function.

It is a further object of the present invention to provide a window cover apparatus that will not hinder the function of night vision equipment.

According to one aspect of the present invention, there is provided a window cover for protection of a vehicle window including an upper armored plate with an upper reflective covering disposed on its underside. Such upper armored plate is mounted at an angle to a vehicle window to provide the greatest range of visibility. A lower armored plate is mounted adjacent a lower portion of the vehicle window. Side armor plates on either end of all of the plates secure such plates within a housing. A lower reflective plate is mounted parallel to the upper armored plate with an upper reflective covering and in front of the lower armored plate, secured at its ends also by the side armor plates. Such parallel mounted upper reflective covering and lower reflective plate function as mirrors and send the light from outside a military vehicle reflecting off the lower reflective plate onto the upper reflective covering, and reflecting off the upper reflective covering into the vehicle where it is perceived by the eyes of the occupant as the view outside the military vehicle. The lower reflective plate is designed to allow the passage of projectiles, such as bullets.

DETAILED DESCRIPTION OF INVENTION

Figure 1:
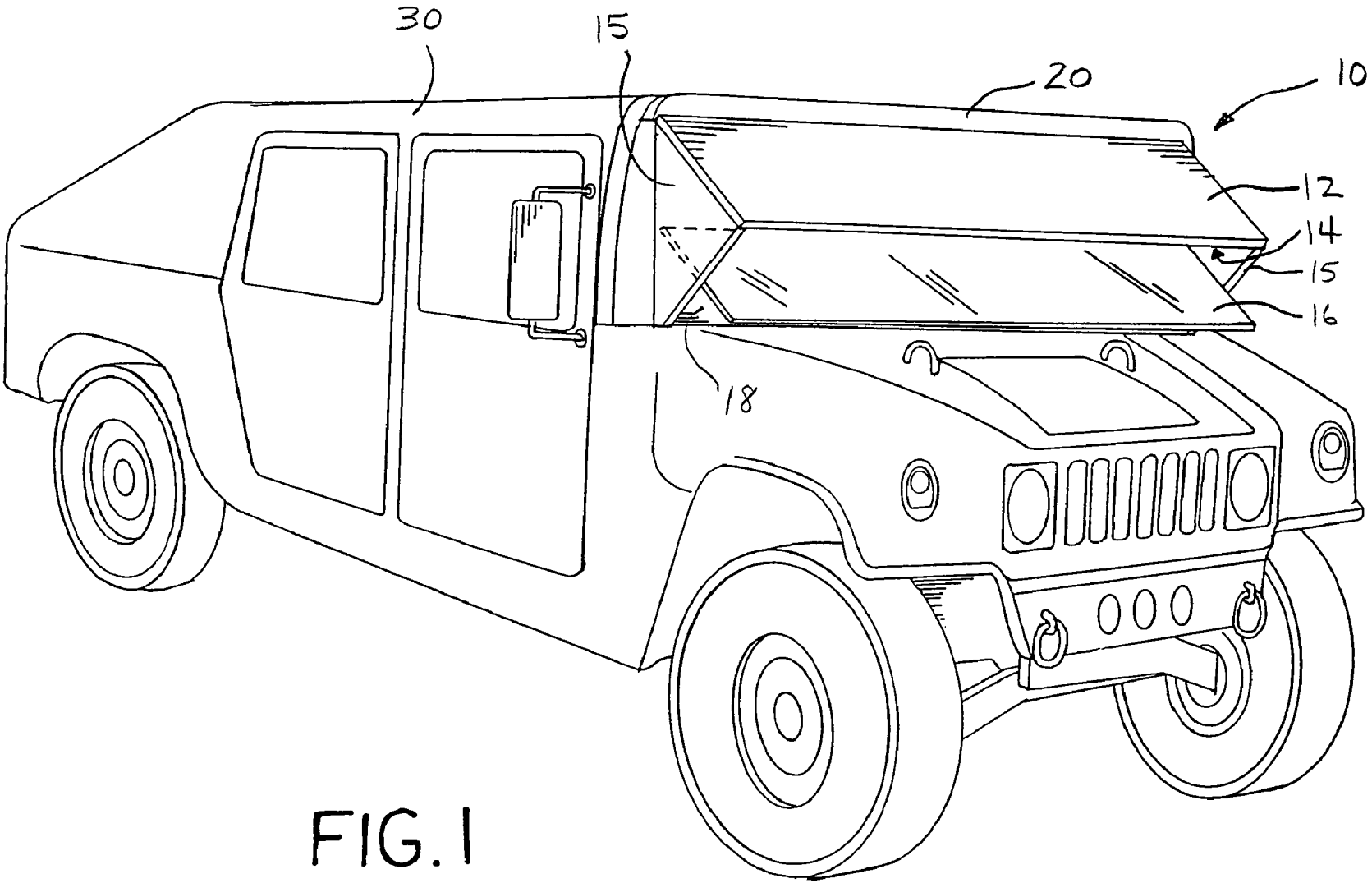
FIG. 1 is a perspective view of a military vehicle with a windshield cover installed according to an embodiment of the present invention.
Figure 2:
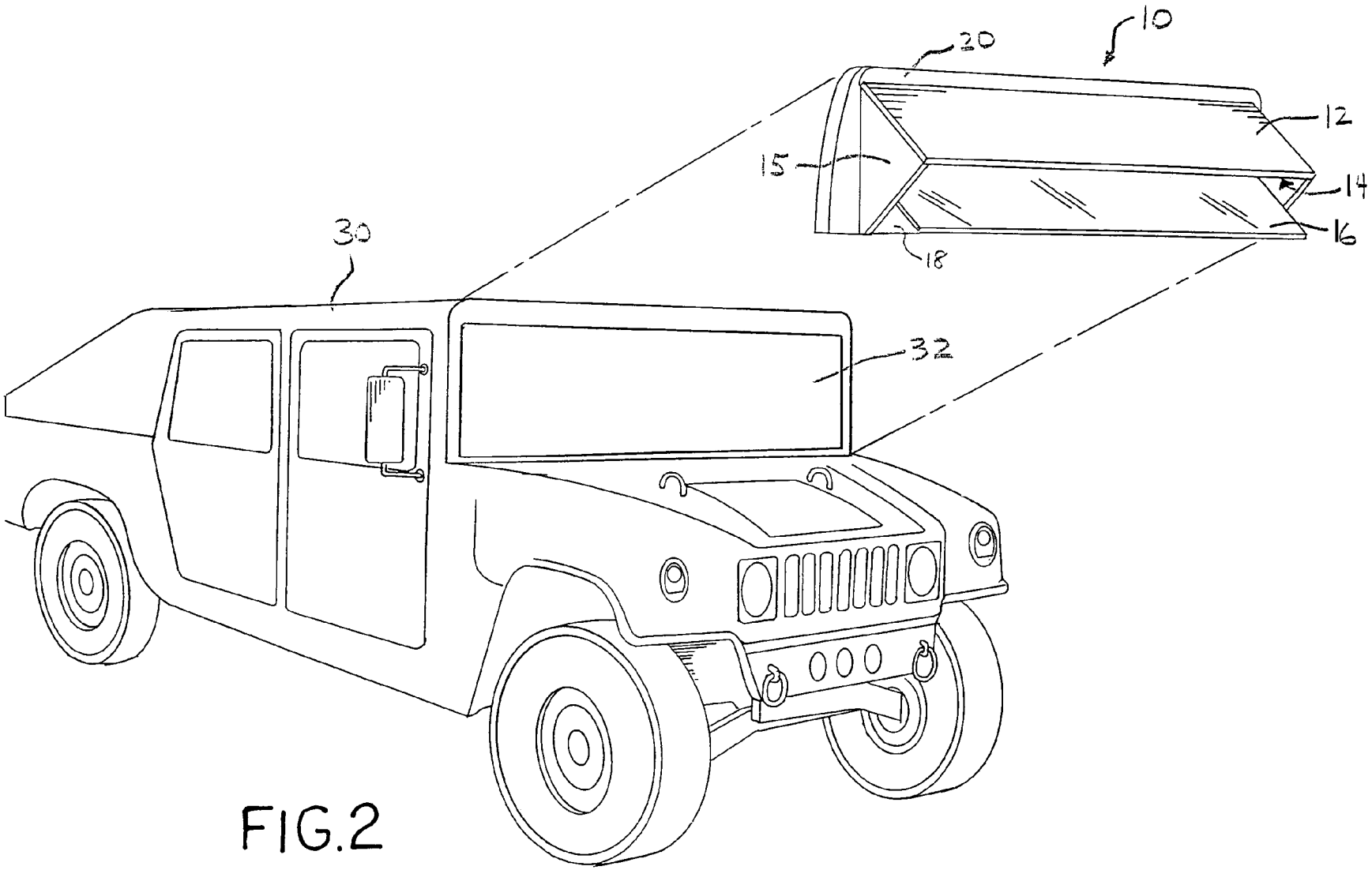
FIG. 2 is perspective view of a military vehicle showing the windshield cover uninstalled.
Figure 3:
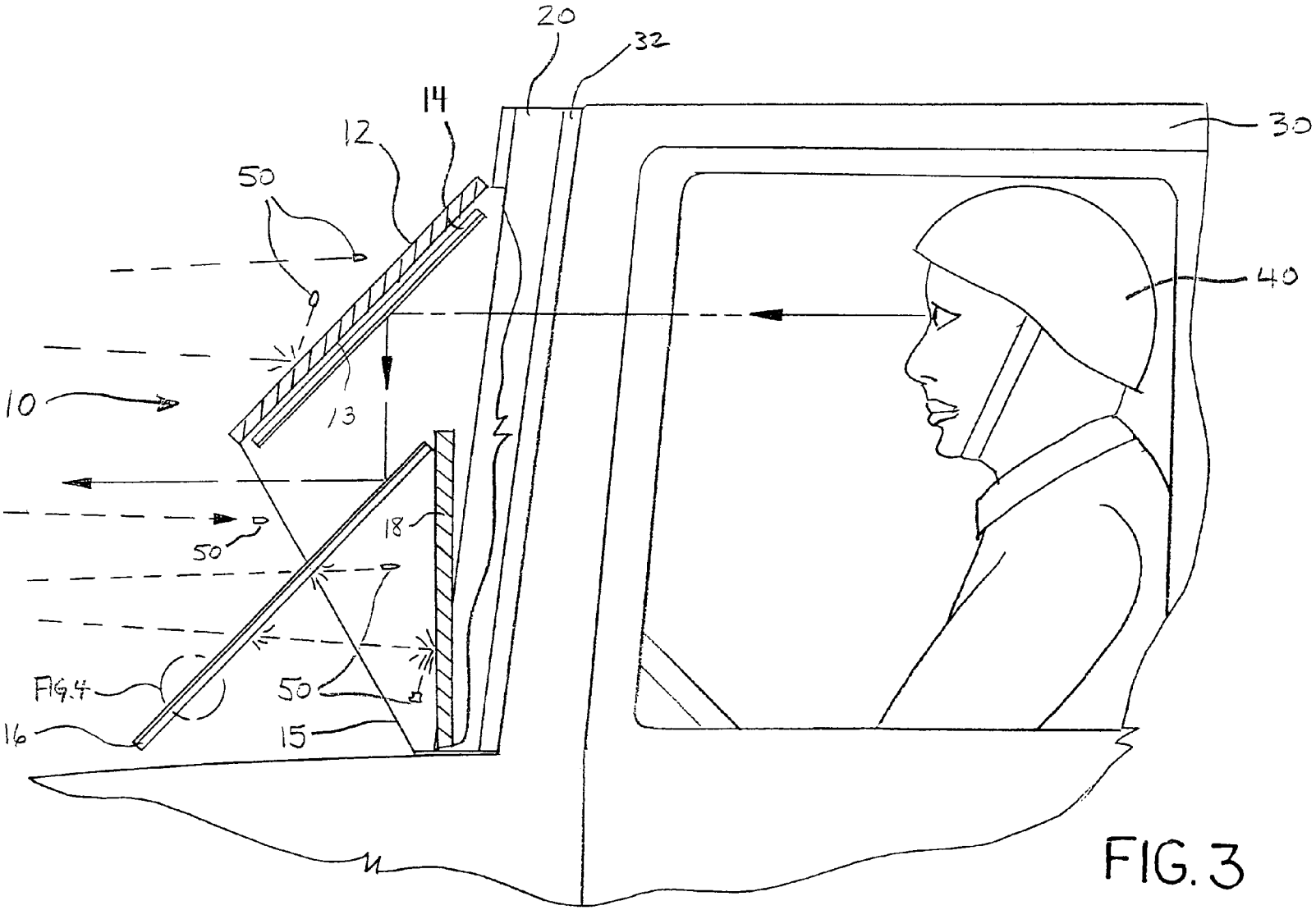
FIG. 3 is a fragmentary side elevational view in partial section of the military vehicle and windshield cover showing the line of sight for a vehicle occupant and the effect of incoming fire.

A window cover 10 is shown in FIGS. 1, 2, 5 and 6 attached to a military vehicle 30. The window cover 10 fits over a vehicle window 32 and is removably mounted in place by suitable fasteners. As seen in FIG. 3, an occupant 40 of the military vehicle 30 is able to utilize the window cover 10 placed over the vehicle window 32 to have an unobstructed view through the vehicle window 32 with projectile 50 protection.

As further seen in FIG. 3, the window cover 10 includes an upper armored plate 12 attached to a window cover frame 20. The upper armored plate 12 is secured at an angle above the vehicle window 32 by side armored plates 15 on either end of the upper armored plate 12. On the underside 13 of upper armored plate 12 is disposed an upper reflector shown as plate 14. This plate 14 is preferably made of a polished metal and has a mirrored outward-facing surface to allow for visibility of the occupant 40 of the military vehicle 30.

Figure 4:
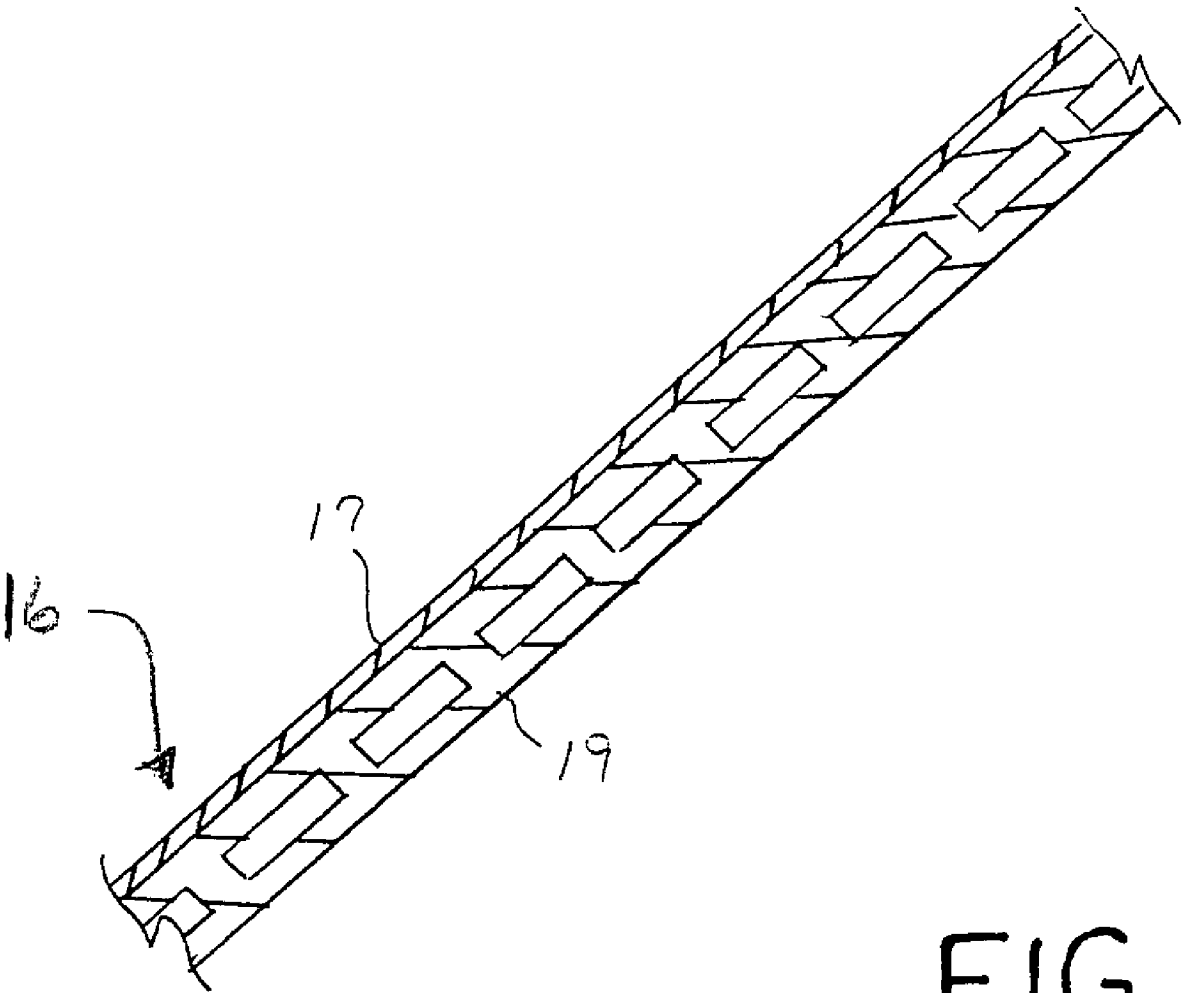
FIG. 4 is a cross-sectional view of the lower reflective plate.
Figure 5:
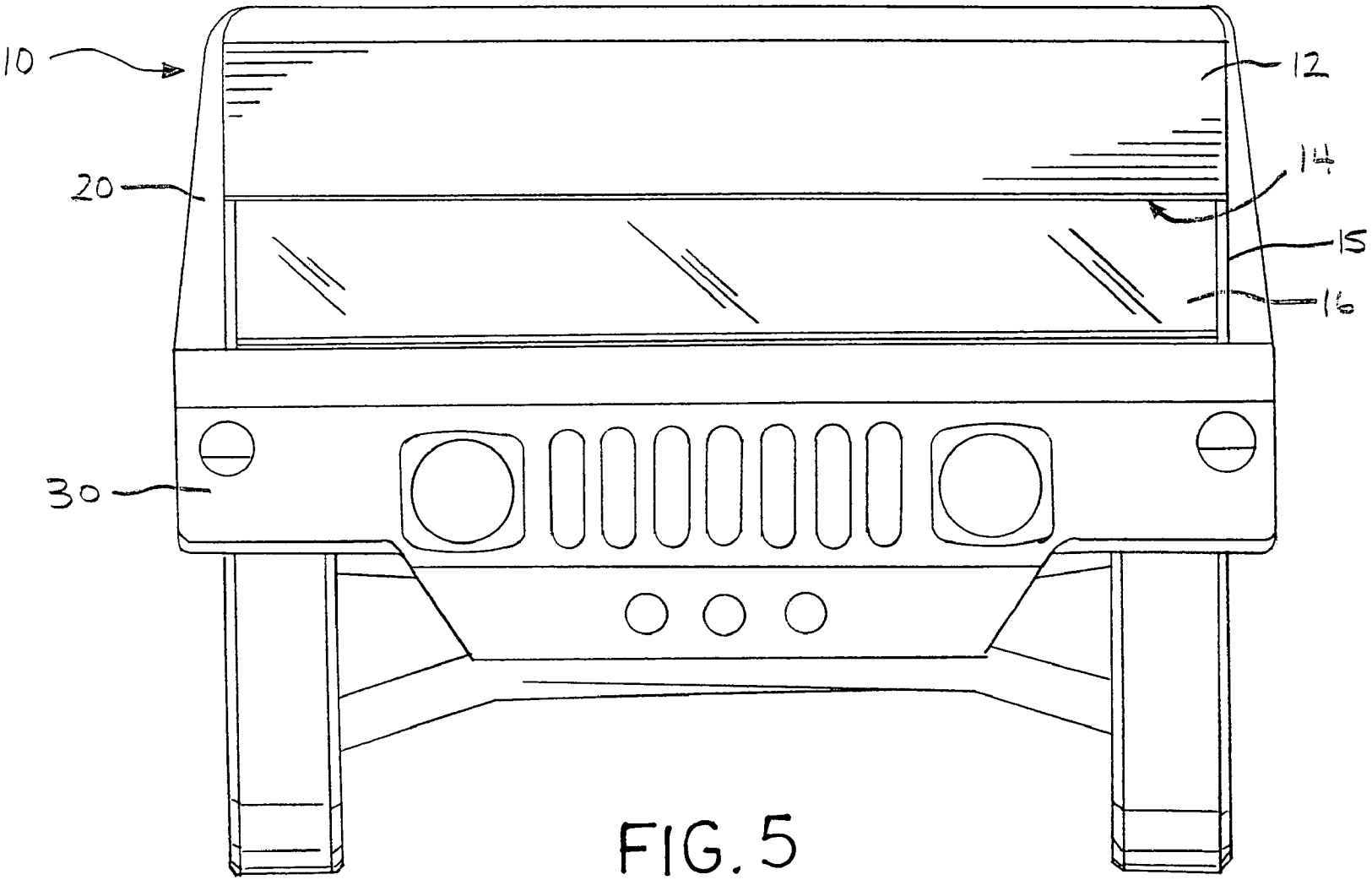
FIG. 5 is front elevational view of a military vehicle showing the windshield cover installed.
Figure 6:
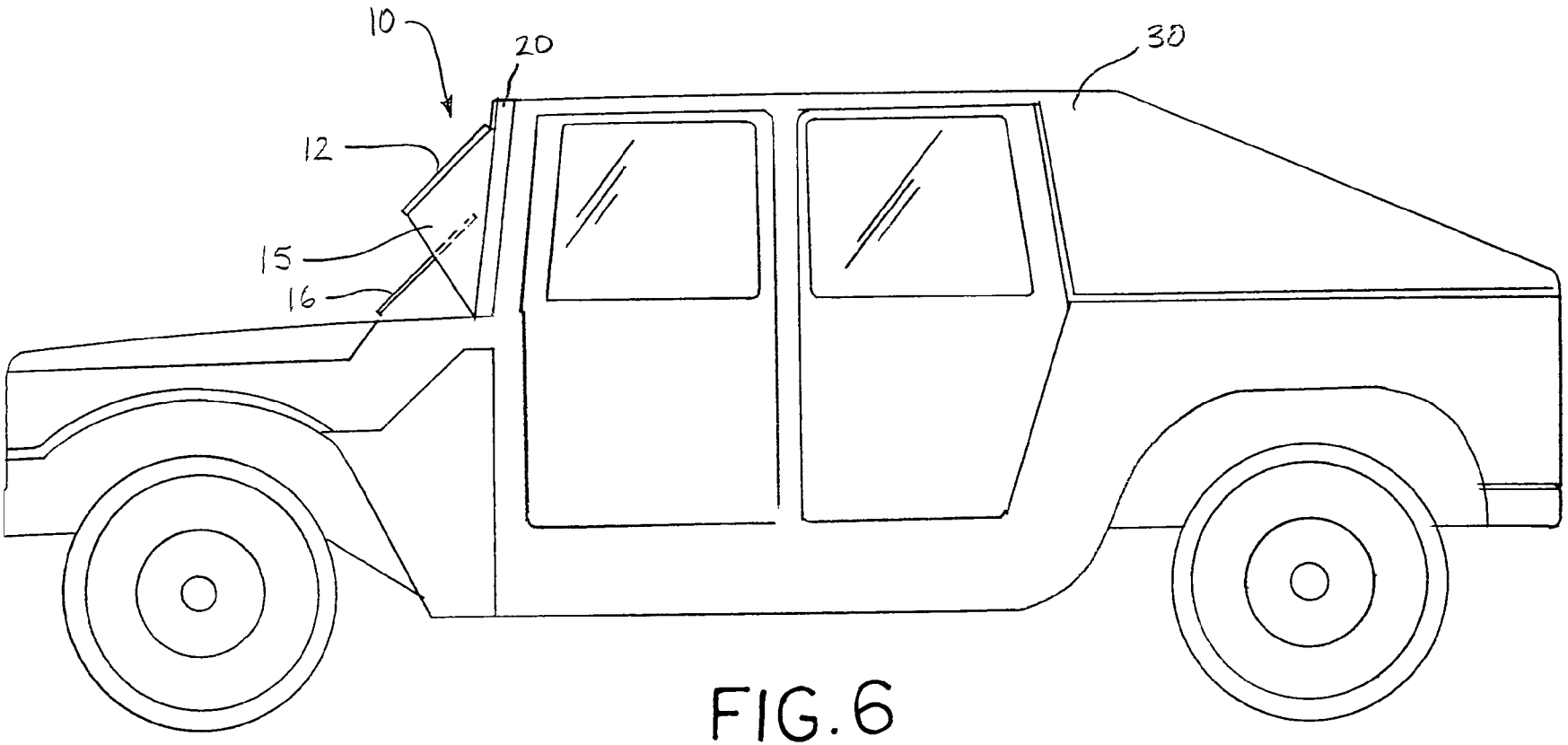
FIG. 6 is a side elevational view of a military vehicle showing the windshield cover installed.

The window cover 10 further includes a lower armored plate 18 directly adjacent and overlying a lower portion of the vehicle window 32, also secured by side armored plates 15 on either end. A lower reflective plate 16 is mounted at an angle over plate 18, parallel to and partially under, upper plates 12 and 14. Lower reflective plate 16 is preferably made of a top polished metal layer 17 with a reflective outward-facing surface applied over a bottom layer 19, preferably made of a lightweight foam, aluminum honeycomb, or plastic material that adds structural integrity to the plate 16. As shown in FIG. 4, plate 16 allows projectiles to easily pierce through the plate 16, leaving a hole only the size of the caliber of the piercing projectile without any shattering of the reflective layer 17. The plate 16 is angled in such a way as to reflect the view in front of the military vehicle 30 onto the reflective surface of plate 14, through the extant vehicle window 32, and into the eyes of the occupant 40.

In operation, the window cover 10 is removably attached over a vehicle window 32 of a military vehicle 30 where it can easily be removed and replaced as needed. As a military vehicle 32 receives fire or is hit with projectiles 50, the window cover 10 provides a protection system for stopping such bullets, shrapnel and the like from piercing through the vehicle window 32, entering the military vehicle 30, and possibly injuring an occupant 40.

As projectiles 50 are projected toward the window cover 10, the upper armored plate 12 will deflect such projectiles 50 and protect the upper reflective plate 14 disposed on the underside of plate 12 from penetration. As such, plate 14 is not exposed to penetration from incoming projectiles 50. However, the lower reflective plate 16 sitting below plates 12 and 14 is exposed to incoming projectiles 50. As a projectile hits plate 16, it passes through cleanly and proceeds in its path until stopped by lower armored plate 18, where the incoming projectiles 50 are deflected or stopped. As the lower reflective plate 16 does not perform the function of stopping the projectiles 50, it does not receive the brunt of the damage and maintains its function as a reflective mirror to project the image outside the vehicle window 32 to the military vehicle occupant 40.

Light coming into the window cover 10 is first reflected off lower plate 16 onto upper reflective plate 14. Plate 14 then reflects the light toward the occupant 40 where it is received as a non-distorted wide-angle image of the view outside the vehicle window 32 as if the window cover 10 was not in place.

The detailed description related herein is meant only to exemplify the preferred embodiment of the invention to enable those skilled in the art to make and use it. The subject invention is not to be limited to the details given above for the preferred embodiment, but may be modified within the scope of the impending claims.

What is claimed is:

1. A window cover for a vehicle, said cover comprising:

an upper armored plate having both a top side and an underside angled away from an underlying window with the underside located adjacent the window;

an upper reflector overlying the underside of the upper armored plate;

a lower armored plate spaced below the upper armored plate and positioned in front of the window; and a lower reflector angled away from the underlying window and lower armored plate, said lower reflector positioned in front of and spaced from said lower armored plate at least partially below said upper reflector, the lower reflector being penetrable by a projectile fired from in front of the vehicle toward the window, said lower armored plate constituting means for stopping or deflecting said projectile after it passes through said lower reflector.

2. The window cover of claim 1 wherein said lower reflector when penetrated by said projectile has a hole therein the size of said projectile.

3. The window cover of claim 2 wherein the upper and lower reflectors are polished steel.

4. The window cover of claim 2 wherein opposite side armored plates are located on each end of the length of the upper and lower armored plates and upper and lower reflectors.

5. The window cover of claim 2 wherein the lower reflector includes a top layer of reflective material and a bottom layer of structurally rigid material.

* * * * *